US007725263B2

(12) United States Patent
Sugiura

(10) Patent No.: US 7,725,263 B2
(45) Date of Patent: May 25, 2010

(54) GRAVITY AZIMUTH MEASUREMENT AT A NON-ROTATING HOUSING

(75) Inventor: Junichi Sugiura, Houston, TX (US)

(73) Assignee: Smith International, Inc., Houston, TX (US)

( * ) Notice: Subject to any disclaimer, the term of this patent is extended or adjusted under 35 U.S.C. 154(b) by 97 days.

(21) Appl. No.: 11/805,213

(22) Filed: May 22, 2007

(65) Prior Publication Data

US 2008/0294343 A1 Nov. 27, 2008

(51) Int. Cl.
*G01V 7/00* (2006.01)

(52) U.S. Cl. ..... 702/9; 702/6; 166/255.2; 175/26; 175/45; 175/61; 33/313; 33/304

(58) Field of Classification Search ..... 702/6, 702/9; 166/255.2; 175/26, 45, 61; 703/9; 33/313, 310, 308, 304, 321; 73/152.46, 152.45, 73/152.03; 340/853.8, 853.1, 856.3
See application file for complete search history.

(56) References Cited

U.S. PATENT DOCUMENTS

| | | | |
|---|---|---|---|
| 2,373,880 | A | 4/1945 | Driscoll |
| 2,603,163 | A | 7/1952 | Nixon |
| 2,874,783 | A | 2/1959 | Haines |
| 2,880,805 | A | 4/1959 | Nelson et al. |
| 2,915,011 | A | 12/1959 | Hamill |
| 3,725,777 | A | 4/1973 | Robinson et al. |
| 3,968,473 | A | 7/1976 | Patton et al. |
| 4,407,374 | A | 10/1983 | Wallussek et al. |
| 4,416,339 | A | 11/1983 | Baker et al. |
| 4,463,814 | A | 8/1984 | Horstmeyer et al. |
| 4,715,440 | A | 12/1987 | Boxell et al. |
| 4,715,451 | A | 12/1987 | Bseisu et al. |
| 4,773,263 | A | 9/1988 | Lesage et al. |
| 4,844,178 | A | 7/1989 | Cendre et al. |
| 4,947,944 | A | 8/1990 | Coltman et al. |
| 4,957,173 | A | 9/1990 | Kinnan |
| 4,958,125 | A | 9/1990 | Jardine et al. |
| 5,070,950 | A | 12/1991 | Cendre et al. |

(Continued)

FOREIGN PATENT DOCUMENTS

EP 1174582 A3 1/2002

(Continued)

OTHER PUBLICATIONS

Schuch, F.J., "Trajectory Equations for Constant Tool Face Angle Deflections," IADC/SPE 23853, p. 111-123, (1992).

(Continued)

*Primary Examiner*—Carol S Tsai

(57) ABSTRACT

Aspects of this invention include methods for surveying a subterranean borehole. In one exemplary aspect, a change in borehole azimuth between first and second longitudinally spaced gravity measurement sensors may be determined directly from gravity measurements made by the sensors and a measured angular position between the sensors. The gravity measurement sensors are typically disposed to rotate freely with respect to one another about a longitudinal axis of the borehole. Gravity MWD measurements in accordance with the present invention may be advantageously made without imposing any relative rotational constraints on first and second gravity sensor sets. The present invention also advantageously provides for downhole processing of the change in azimuth between the first and second gravity sensor sets. As such, Gravity MWD measurements in accordance with this invention may be advantageously utilized in closed-loop steering control methods.

24 Claims, 5 Drawing Sheets

U.S. PATENT DOCUMENTS

| | | | | |
|---|---|---|---|---|
| 5,128,867 | A | 7/1992 | Helm | |
| 5,168,941 | A | 12/1992 | Krueger et al. | |
| 5,226,332 | A | 7/1993 | Wassell | |
| 5,313,829 | A | 5/1994 | Paslay et al. | |
| 5,355,950 | A | 10/1994 | Zwart | |
| 5,448,911 | A | 9/1995 | Mason | |
| 5,512,830 | A | 4/1996 | Kuckes | |
| 5,603,386 | A | 2/1997 | Webster | |
| 5,629,480 | A | 5/1997 | Herget | |
| 5,657,826 | A | 8/1997 | Kuckes | |
| 5,675,488 | A | 10/1997 | McElhinney | |
| 5,721,376 | A | 2/1998 | Pavone et al. | |
| 5,787,997 | A | 8/1998 | Hartmann | |
| 5,797,453 | A | 8/1998 | Hisaw | |
| 5,864,058 | A | 1/1999 | Chen | |
| 5,941,323 | A | 8/1999 | Warren | |
| 6,065,332 | A | 5/2000 | Dominick | |
| 6,068,394 | A | 5/2000 | Dublin, Jr. | |
| 6,092,610 | A | 7/2000 | Kosmala et al. | |
| 6,148,933 | A | 11/2000 | Hay et al. | |
| 6,158,529 | A | 12/2000 | Dorel | |
| 6,216,802 | B1 | 4/2001 | Sawyer | |
| 6,267,185 | B1 | 7/2001 | Mougel et al. | |
| 6,268,726 | B1 | 7/2001 | Prammer et al. | |
| 6,290,003 | B1 | 9/2001 | Russell | |
| 6,321,456 | B1 | 11/2001 | McElhinnney | |
| 6,427,783 | B2 | 8/2002 | Krueger et al. | |
| 6,480,119 | B1 | 11/2002 | McElhinney | |
| 6,518,756 | B1 | 2/2003 | Morys et al. | |
| 6,608,565 | B1 | 8/2003 | Van Steenwyk et al. | |
| 6,609,579 | B2 | 8/2003 | Krueger et al. | |
| 6,631,563 | B2 * | 10/2003 | Brosnahan et al. | 33/313 |
| 6,647,637 | B2 | 11/2003 | Lechen | |
| 6,681,633 | B2 | 1/2004 | Schultz et al. | |
| 6,691,804 | B2 | 2/2004 | Harrison | |
| 6,702,010 | B2 | 3/2004 | Yuratich et al. | |
| 6,742,604 | B2 | 6/2004 | Brazil et al. | |
| 6,761,232 | B2 | 7/2004 | Moody et al. | |
| 6,842,699 | B2 * | 1/2005 | Estes | 702/9 |
| 6,842,990 | B2 * | 1/2005 | Taylor | 33/304 |
| 6,848,189 | B2 | 2/2005 | Moake et al. | |
| 6,883,240 | B2 * | 4/2005 | Russell et al. | 33/313 |
| 6,885,188 | B2 | 4/2005 | Russell | |
| 6,937,023 | B2 | 8/2005 | McElhinney | |
| 6,944,545 | B2 * | 9/2005 | Close et al. | 702/6 |
| 7,002,484 | B2 | 2/2006 | McElhinney | |
| 7,028,409 | B2 | 4/2006 | Engebretson et al. | |
| 7,080,460 | B2 * | 7/2006 | Illfelder | 33/313 |
| 7,143,521 | B2 | 12/2006 | Haugland | |
| 7,243,719 | B2 * | 7/2007 | Baron et al. | 166/255.2 |
| 7,385,400 | B2 | 6/2008 | Moore | |
| 7,386,942 | B2 * | 6/2008 | Seigel | 33/313 |
| 2001/0041963 | A1 | 11/2001 | Estes et al. | |
| 2002/0124652 | A1 | 9/2002 | Schultz et al. | |
| 2002/0144417 | A1 | 10/2002 | Russell et al. | |
| 2003/0056381 | A1 * | 3/2003 | Brosnahan et al. | 33/313 |
| 2003/0070844 | A1 | 4/2003 | Radzinski et al. | |
| 2003/0184305 | A1 | 10/2003 | Niina | |
| 2003/0209365 | A1 | 11/2003 | Downton | |
| 2004/0073369 | A1 | 4/2004 | McElhinney | |
| 2004/0206170 | A1 | 10/2004 | Chen et al. | |
| 2004/0222019 | A1 | 11/2004 | Estes et al. | |
| 2004/0238222 | A1 | 12/2004 | Harrison | |
| 2004/0239313 | A1 | 12/2004 | Godkin | |
| 2004/0249573 | A1 | 12/2004 | McElhinney | |
| 2004/0251898 | A1 | 12/2004 | Morys et al. | |
| 2005/0001737 | A1 | 1/2005 | Baron et al. | |
| 2005/0034985 | A1 | 2/2005 | Zamanzadeh et al. | |
| 2005/0150694 | A1 | 7/2005 | Schuh | |
| 2005/0189938 | A1 | 9/2005 | Schley et al. | |
| 2005/0189946 | A1 * | 9/2005 | Moore | 324/338 |
| 2005/0268476 | A1 * | 12/2005 | Illfelder | 33/313 |
| 2005/0269082 | A1 | 12/2005 | Baron et al. | |
| 2006/0021797 | A1 | 2/2006 | Krueger | |
| 2006/0185902 | A1 | 8/2006 | Song et al. | |
| 2006/0260843 | A1 * | 11/2006 | Cobern | 175/45 |

FOREIGN PATENT DOCUMENTS

| | | | |
|---|---|---|---|
| GB | 1585479 | | 3/1981 |
| GB | 2086055 | A | 5/1982 |
| GB | 2321970 | A | 8/1998 |
| GB | 2331811 | A | 6/1999 |
| GB | 2370645 | A | 7/2002 |
| GB | 2394779 | A | 5/2004 |
| GB | 2398638 | A | 8/2004 |
| GB | 2398879 | A | 9/2004 |
| GB | 2402746 | A | 12/2004 |
| GB | 2405927 | A | 3/2005 |
| WO | WO-01-51761 | A1 | 7/2001 |
| WO | WO-03-097989 | A1 | 11/2003 |

OTHER PUBLICATIONS

McElhinney, G., Sognnes, R., and Smith, B., "Case Histories Demonstrate a New Method for Well Avoidance and Relief Well Drilling," SPE/IADC 37667 (1997).

Berger, P.E. and Sele, R., "Improving Wellbore Position Accuracy of Horizontal Wells by Using a Continuous Inclination Measurement from a Near Bit Inclination MWD Sensor," SPE 50378 (1998).

McElhinney, G.A., Margeirsson, A., Hamlin, K., and Blok, I., "Gravity MWD: A New Technique to Determine Your Well Path," 2000 IADC/SPE Drilling Conference, New Orleans, Louisiana, Feb. 23-25, 2000, IADC/SPE Paper No. 59200.

Sawaryn, S.J. And Thorogood, J.L., "A Compendium of Directional Calculations Based on the Minimum Curvature Method," SPE 84246 (2003).

Matheson, E., McElhinney, G. and R. Lee, "The First Use of Gravity MWD in Offshore Drilling Delivers Reliable Azimuth," SPE 87166 (2004).

Illfelder, Herbert, Hamlin, Ken, and McElhinney, Graham, "A Gravity-Based Measurement-While-Drilling Technique Determines Borehole Azimuth From Toolface and Inclination Measurements," ADDE 2005 National Technical Conference and Exhibition, Houston, Texas, Apr. 2-7, 2005, AADE-05-NTCE-67.

Chen, D.C-K., Comeaux, B., Gilespie, G., Irvine, G. and Wiecek, B., "Real-Time Downhole Torsional Vibration Monitor for Improving Tool Performance and Bit Design," IADC/SPE Drilling Conference, Miami, Florida, Feb. 21-23, 2006, IADC/SPE Paper No. 99193.

Marketing material MagTraC 06-03 by Scientific Drilling available for download at http://www.scientificdrilling.com/pdf/magtrac%20overview.pdf.

Panasonic Hybrid IC brochure No. ENQ39, dated Mar. 2005.

* cited by examiner

GRAVITY AZIMUTH MEASUREMENT AT A NON-ROTATING HOUSING

RELATED APPLICATIONS

None.

FIELD OF THE INVENTION

The present invention relates generally to downhole tools, for example, including directional drilling tools having one or more steering blades. More particularly, embodiments of this invention relate to a surveying method in which gravity measurement sensors are utilized to determine a change in borehole azimuth between first and second longitudinally spaced positions in a borehole.

BACKGROUND OF THE INVENTION

The use of accelerometers in conventional surveying techniques is well known. The use of magnetometers or gyroscopes in combination with one or more accelerometers to determine direction is also known. Deployments of such sensor sets are well known to determine borehole characteristics such as inclination, azimuth, positions in space, gravity toolface, magnetic toolface, and magnetic azimuth (i.e., an azimuth value determined from magnetic field measurements). While magnetometers and gyroscopes may provide valuable information to the surveyor, their use in borehole surveying, and in particular measurement while drilling (MWD) applications, tends to be limited by various factors. For example, magnetic interference, such as from magnetic steel or ferrous minerals in formations or ore bodies, tends to cause errors in the azimuth values obtained from a magnetometer. Motors, stabilizers, and bits used in directional drilling applications are typically permanently magnetized during magnetic particle inspection processes, and thus magnetometer readings obtained low in the bottom hole assembly (BHA) are often unreliable. Gyroscopes are sensitive to high temperature and vibration and thus tend to be difficult to utilize in drilling applications. Gyroscopes also require a relatively long time interval (as compared to accelerometers and magnetometers) to obtain accurate readings. Furthermore, at low angles of inclination (i.e., near vertical); it becomes very difficult to obtain accurate azimuth values from gyroscopes.

U.S. Pat. No. 6,480,119 to McElhinney and commonly assigned U.S. Pat. No. 7,080,460 to Illfelder disclose techniques for determining borehole azimuth via tri-axial accelerometer measurements made at first and second longitudinal positions on a drill string. Using gravity as a primary reference, the disclosed methods make use of the inherent bending of the structure between the accelerometer sets in order to calculate a change in borehole azimuth between the first and second positions. The disclosed methods assume that the tri-axial accelerometer sets are spaced by a known distance via a rigid structure, such as a drill collar, that prevents relative rotation between the sets. Gravity based methods for determining borehole azimuth, including the McElhinney and Illfelder methods, as well as exemplary embodiments of the present invention, are referred to herein as Gravity MWD.

While the Gravity MWD techniques disclosed by McElhinney and Illfelder are known to be commercially serviceable, there is yet room for further improvement. For example, the physical constraint that the accelerometer sets be rotationally fixed relative to one another imposes a constraint on the structure of the BHA. It would be highly advantageous to extend Gravity MWD methods to eliminate this constraint and thereby allow relative rotation between the first and second accelerometer sets.

The Illfelder patent further discloses that the change in borehole azimuth can be determined from borehole inclination and gravity toolface measurements using numerical root finding algorithms, graphical methods, and/or look-up tables. Such methods are readily available and easily utilized at the surface, e.g., via a conventional PC using software routines available in MathCad® and/or Mathematica®. However, it is difficult to apply such numerical and/or graphical methods using on-board, downhole processors due to their limited processing power. This is particularly so in smaller diameter tools which require physically smaller processors (which therefore typically have lower processing power). Furthermore, surface processing tends to be disadvantageous in that it requires transmission of multiple high resolution (e.g., 12 bit) gravity measurement values or inclination and tool face angles to the surface. Such downhole to surface transmission is often accomplished via bandwidth limited mud pulse telemetry techniques.

Therefore there also exists a need for a simplified method for determining the change in borehole azimuth, preferably including calculations that can be readily achieved using a low-processing-power downhole processor.

SUMMARY OF THE INVENTION

The present invention addresses one or more of the above-described drawbacks of prior art gravity surveying techniques. Exemplary embodiments of the present invention advantageously remove the above described rotational constraint between longitudinally spaced Gravity MWD sensors. One exemplary aspect of this invention includes a method for surveying a subterranean borehole. A change in borehole azimuth between first and second longitudinally spaced gravity measurement sensors may be determined directly from gravity measurements made by the sensors and a measured angular position between the sensors. The gravity measurement sensors are typically disposed to rotate freely with respect to one another about a longitudinal axis of the borehole. Relative rotation is accounted via measurements of the relative angular position between the first and second sensors. The change in azimuth is typically processed downhole (in a downhole processor) via a simplified algorithm (simplified as compared to prior art Gravity MWD algorithms).

Exemplary embodiments of the present invention may advantageously provide several technical advantages. For example, Gravity MWD measurements in accordance with the present invention may be advantageously made without imposing any rotational constraints between the first and second gravity sensor sets. Elimination of the prior art rotational constraints advantageously provides for improved flexibility in BHA design. For example, in one exemplary embodiment of the invention, a first gravity sensor may be rotationally coupled with the drill string (e.g., in a conventional MWD tool) while the second gravity sensor may be deployed in a substantially non-rotating housing (e.g., a conventional rotary steerable tool blade housing). Such deployments advantageously enable near-bit borehole azimuth measurements to be made free from the effects of magnetic interference.

The present invention also advantageously provides for downhole processing of the change in azimuth between the first and second gravity sensor sets. As such, Gravity MWD measurements in accordance with this invention may be advantageously utilized in closed-loop steering control methods.

In one aspect the present invention includes a method for surveying a subterranean borehole. The method includes providing a string of downhole tools including first and second gravity measurement devices at corresponding first and second longitudinal positions in the borehole. The first and second gravity measurement devices are substantially free to rotate with respect to one another about a substantially cylindrical borehole axis. The string of tools further includes an angular position sensor disposed to measure a relative angular position between the first and second gravity measurement devices. The method further includes causing the first and second gravity measurement devices to measure corresponding first and second gravity vector sets and causing the angular position sensor to measure a corresponding relative angular position between the first and second gravity measurement devices. The method still further includes processing the first and second gravity vector sets and the angular position to calculate a change in borehole azimuth between the first and second positions in the borehole.

In another aspect this invention includes a method for surveying a subterranean borehole. The method includes providing first and second gravity measurement devices at corresponding first and second longitudinal positions in the borehole and causing the first and second gravity measurement devices to measure corresponding first and second gravity vector sets. The method further includes processing downhole the first and second gravity vector sets to calculate a change in borehole azimuth between the first and second positions in the borehole.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
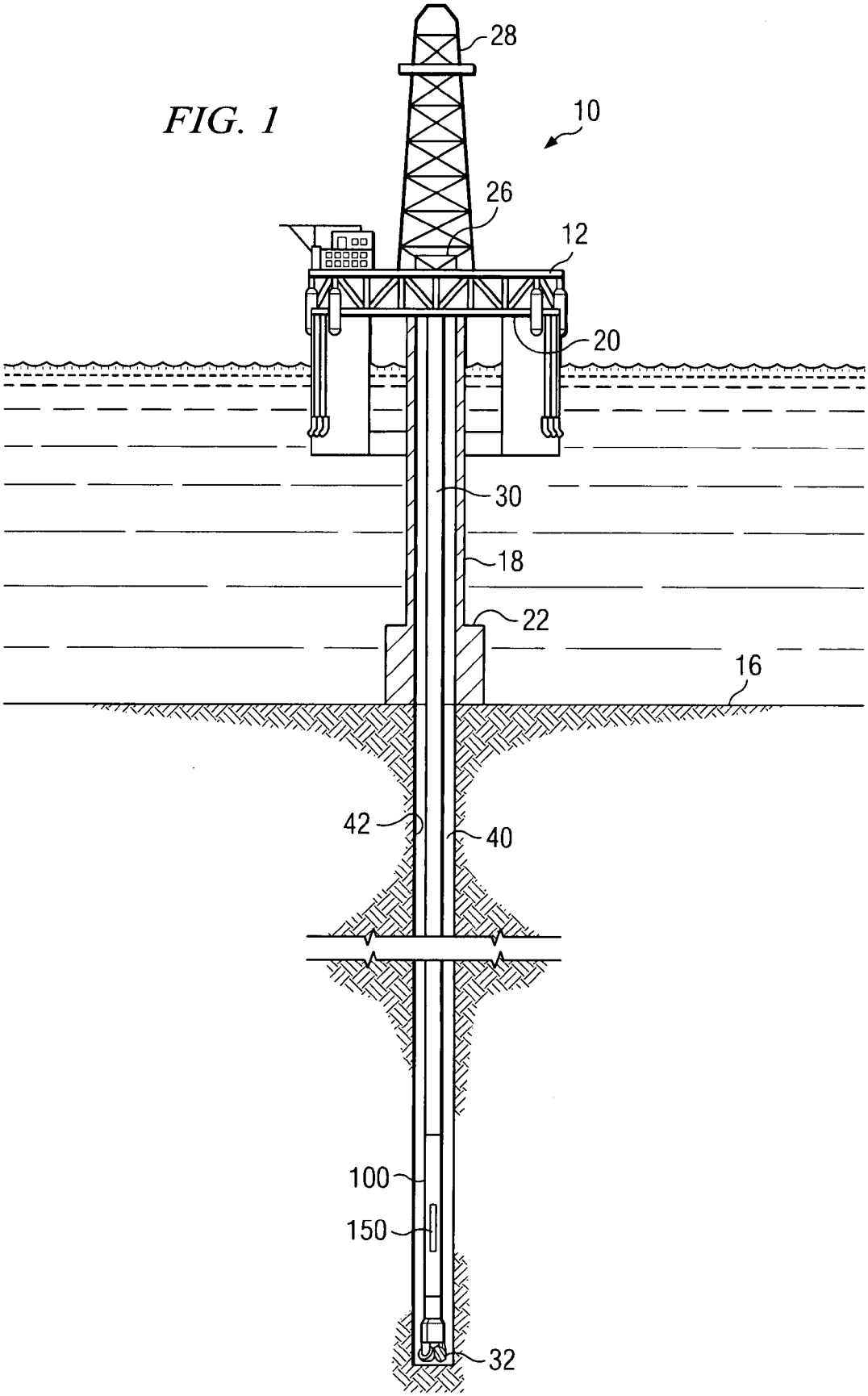
FIG. 1 depicts a drilling rig on which exemplary embodiments of the present invention may be deployed.

Before proceeding with a discussion of the present invention, it is necessary to make clear what is meant by "azimuth" as used herein. The term azimuth has been used in the downhole drilling arts in two contexts, with a somewhat different meaning in each context. In a general sense, an azimuth angle is a horizontal angle from a fixed reference position. Mariners performing celestial navigation used the term, and it is this use that apparently forms the basis for the generally understood meaning of the term azimuth. In celestial navigation, a particular celestial object is selected and then a vertical circle, with the mariner at its center, is constructed such that the circle passes through the celestial object. The angular distance from a reference point (usually magnetic north) to the point at which the vertical circle intersects the horizon is the azimuth. As a matter of practice, the azimuth angle was usually measured in the clockwise direction.

In this traditional meaning of azimuth, the reference plane is the horizontal plane tangent to the earth's surface at the point from which the celestial observation is made. In other words, the mariner's location forms the point of contact between the horizontal azimuthal reference plane and the surface of the earth. This context can be easily extended to a downhole drilling application. A borehole azimuth in the downhole drilling context is the relative bearing direction of the borehole at any particular point in a horizontal reference frame. Just as a vertical circle was drawn through the celestial object in the traditional azimuth calculation, a vertical circle may also be drawn in the downhole drilling context with the point of interest within the borehole being the center of the circle and the tangent to the borehole at the point of interest being the radius of the circle. The angular distance from the point at which this circle intersects the horizontal reference plane and the fixed reference point (e.g., magnetic north) is referred to as the borehole azimuth. And just as in the celestial navigation context, the borehole azimuth is typically measured in a clockwise direction.

It is this meaning of "azimuth" that is used to define the course of a drilling path. The borehole inclination is also used in this context to define a three-dimensional bearing direction of a point of interest within the borehole. Inclination is the angular separation between a tangent to the borehole at the point of interest and vertical. The azimuth and inclination values are typically used in drilling applications to identify bearing direction at various points along the length of the borehole. A set of discrete inclination and azimuth measurements along the length of the borehole is further commonly utilized to assemble a well survey (e.g., using the minimum curvature assumption). Such a survey describes the three-dimensional location of the borehole in a subterranean formation.

A somewhat different meaning of "azimuth" is found in some borehole imaging art. In this context, the azimuthal reference plane is not necessarily horizontal (indeed, it seldom is). When a borehole image of a particular formation property is desired at a particular point in the borehole, measurements of the property are taken at points around the circumference of the measurement tool. The azimuthal reference plane in this context is the plane centered at the measurement tool and perpendicular to the longitudinal direction of the borehole at that point. This plane, therefore, is fixed by the particular orientation of the borehole measurement tool at the time the relevant measurements are taken.

An azimuth in this borehole imaging context is the angular separation in the azimuthal reference plane from a reference point to the measurement point. The azimuth is typically measured in the clockwise direction, and the reference point is frequently the high side of the borehole or measurement tool, relative to the earth's gravitational field, though magnetic north may be used as a reference direction in some situations. Though this context is different, and the meaning of azimuth here is somewhat different, this use is consistent with the traditional meaning and use of the term azimuth. If the longitudinal direction of the borehole at the measurement point is equated to the vertical direction in the traditional context, then the determination of an azimuth in the borehole imaging context is essentially the same as the traditional azimuthal determination.

Another important label used in the borehole imaging context is "toolface angle". When a measurement tool is used to gather azimuthal imaging data, the point of the tool with the measuring sensor is identified as the "face" of the tool. The toolface angle, therefore, is defined as the angular separation from a reference point to the radial direction of the toolface. The assumption here is that data gathered by the measuring sensor will be indicative of properties of the formation along a line or path that extends radially outward from the toolface into the formation. The toolface angle is an azimuth angle, where the measurement line or direction is defined for the position of the tool sensors. The oilfield services industry uses the term "gravitational toolface" when the toolface angle has a gravity reference (e.g., the high side of the borehole) and "magnetic toolface" when the toolface angle has a magnetic reference (e.g., magnetic north).

In the remainder of this document, when referring to the course of a drilling path (i.e., a drilling direction), the term "borehole azimuth" will be used. Thus, a drilling direction may be defined, for example, via a borehole azimuth and an inclination (or borehole inclination). The terms toolface and azimuth will be used interchangeably, though the toolface identifier will be used predominantly, to refer to an angular position about the circumference of a downhole tool (or about the circumference of the borehole). Thus, an LWD sensor, for example, may be described as having an azimuth or a toolface.

Referring first to FIGS. 1 to 10, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 to 10 may be described herein with respect to that reference numeral shown on other views.

FIG. 1 illustrates a drilling rig 10 suitable for utilizing exemplary downhole tool and method embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a directional drilling tool 100 (such as a three-dimensional rotary steerable tool). In the exemplary embodiment shown, steering tool 100 includes one or more, usually three, blades 150 disposed to extend outward from the tool 100 and apply a lateral force and/or displacement to the borehole wall 42. The extension of the blades deflects the drill string 30 from the central axis of the borehole 40, thereby changing the drilling direction. Drill string 30 may further include a downhole drilling motor, a mud pulse telemetry system, and one or more additional sensors, such as LWD and/or MWD tools for sensing downhole characteristics of the borehole and the surrounding formation. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore. Moreover, while the invention is described with respect to exemplary three-dimensional rotary steerable (3DRS) tool embodiments, it will also be understood that the present invention is not limited in this regard. The invention is equally well suited for use in substantially any downhole tool requiring an angular position measurement of one component (e.g., a shaft) with respect to another (e.g., a sleeve deployed about the shaft).

Figure 2:
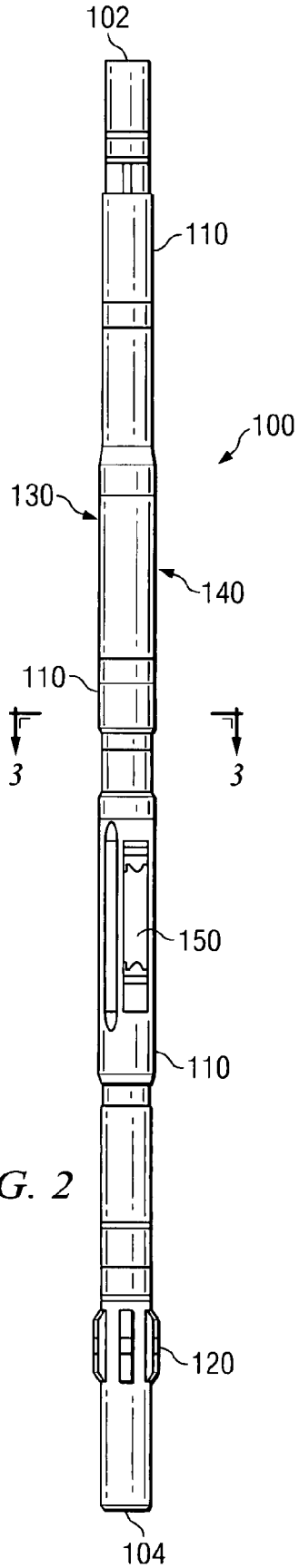
FIG. 2 is a perspective view of the steering tool shown on FIG. 1.

Turning now to FIG. 2, one exemplary embodiment of rotary steerable tool 100 from FIG. 1 is illustrated in perspective view. In the exemplary embodiment shown, rotary steerable tool 100 is substantially cylindrical and includes threaded ends 102 and 104 (threads not shown) for connecting with other bottom hole assembly (BHA) components (e.g., connecting with the drill bit at end 104). The rotary steerable tool 100 further includes a housing 110 deployed about a shaft (not shown on FIG. 2). The shaft is typically configured to rotate relative to the housing 110. The housing 110 further includes at least one blade 150 deployed, for example, in a recess (not shown) therein. Directional drilling tool 100 further includes hydraulics 130 and electronics 140 modules (also referred to herein as control modules 130 and 140) deployed in the housing 110. In general, the control modules 130 and 140 are configured for sensing and controlling the relative positions of the blades 150. As described in more detail below, electronic module also typically includes a tri-axial arrangement of accelerometers with one of the accelerometer having a known orientation relative to the longitudinal axis of the tool 100.

To steer (i.e., change the direction of drilling), one or more of blades 150 are extended and exert a force against the borehole wall. The rotary steerable tool 100 is moved away from the center of the borehole by this operation, thereby altering the drilling path. In general, increasing the offset (i.e., increasing the distance between the tool axis and the borehole axis via extending one or more of the blades) tends to increase the curvature (dogleg severity) of the borehole upon subsequent drilling. The tool 100 may also be moved back towards the borehole axis if it is already eccentered. It will be understood that the drilling direction (whether straight or curved) is determined by the positions of the blades with respect to housing 110 as well as by the angular position (i.e., the azimuth) of the housing 110 in the borehole.

Angular Sensor Embodiments

Figure 3:
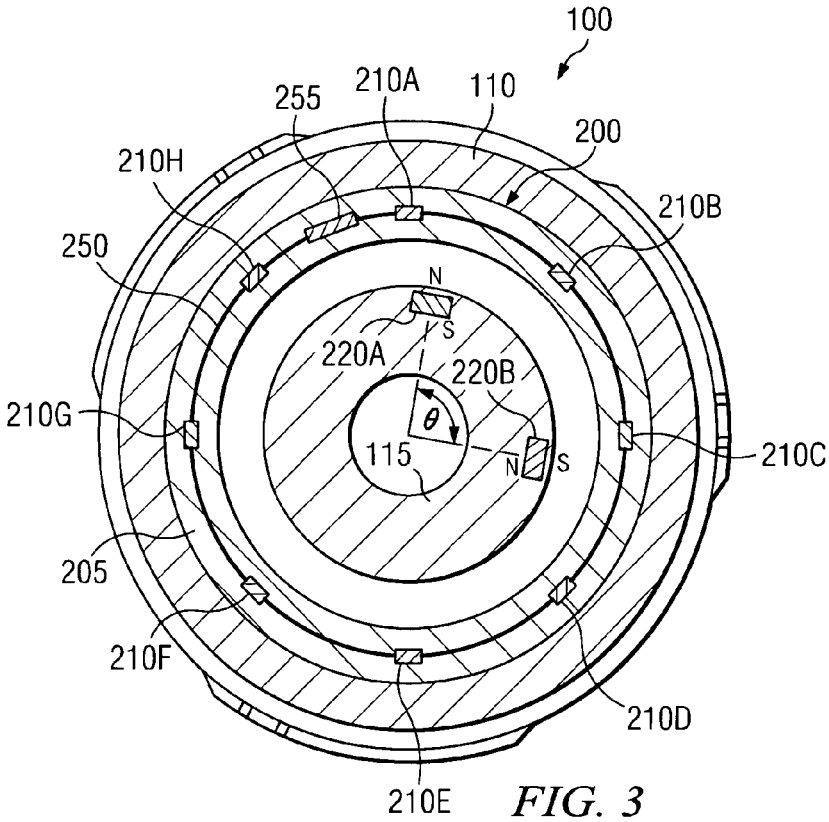
FIG. 3 depicts, in cross section, another portion of the steering tool shown on FIG. 2 showing an exemplary angular sensor deployment in accordance with the present invention.

With reference now to FIG. 3, one exemplary embodiment of an angular sensor 200 in accordance with the present invention is depicted in cross section. Angular sensor 200 is disposed to measure the relative angular position between shaft 115 and housing 110 and may be deployed, for example, in control module 140 (FIG. 2). In the exemplary embodiment shown, angular sensor 200 includes first and second magnets 220A and 220B deployed on the shaft 115 and a plurality of magnetic field sensors 210A-H deployed about the circumference of the housing 110. The invention is not limited in this regard, however, as the magnets 220A and 220B may be deployed on the housing 110 and magnetic field sensors 210A-H on the shaft 115.

Magnets 220A and 220B are angularly offset about the circumference of the shaft 115 by an angle θ. In the exemplary embodiment shown, magnets 220A and 220B are angularly offset by an angle of 90 degrees, however, the invention is not limited in this regard. Magnets 220A and 220B may be angularly offset by substantially any suitable angle. Angles in the range from about 30 to about 180 degrees are generally advantageous. Magnets 220A and 220B also typically have substantially equal magnetic pole strengths and opposite polarity, although the invention is expressly not limited in this regard. In the exemplary embodiment shown on FIG. 3, magnet 220A includes an approximately cylindrical magnet having a magnetic north pole facing radially outward from the tool axis while magnetic 220B includes an approximately cylindrical magnet having a magnetic south pole facing radially outward towards the tool axis. It will be appreciated that other more complex magnetic arrangements may be utilized. Certain other arrangements are described in more detail below with respect to FIGS. 5-8B. In one other alternative arrangement, magnets 220A and 220B may each include first and second magnets having opposing magnetic poles facing one another such that magnetic flux emanates radially outward from the tool axis (or inward towards the tool axis depending upon the polarity of the magnets). In such an embodiment, magnet 220A may include north-north opposing poles, for example, while magnet 220B may include south-south opposing poles.

With continued reference to FIG. 3, magnetic field sensors 210A-H are deployed about the circumference of the tool 100 such that at least two of the sensors 210A-H are within sensory range of magnetic flux emanating from the magnets 220A and 220B. In the exemplary embodiment shown, at least sensors 210A and 210C are in sensory range of the magnetic flux. Magnetic field sensors 210A-H may include substantially any type of magnetic sensor, e.g., including magnetometers, reed switches, magnetoresistive sensors, and/or Hall-Effect sensors, however magnetoresistive sensors and Hall-Effect sensors are generally preferred. Moreover, each sensor may have either a ratiometric (analog) or digital output. While FIG. 3 shows eight magnetic field sensors 210A-H, it will be appreciated by those of ordinary skill on the art that this invention may equivalently utilize substantially any suitable plurality of magnetic field sensors. Typically from about four to about sixteen sensors are preferred. Too few sensors tend to result in a degradation of angular sensitivity (although degraded angular sensitivity may be acceptable, for example, in certain LWD imaging applications in which the LWD sensor has poor angular sensitivity). The use of sixteen or more sensors, while providing excellent angular sensitivity, increases wiring and power requirements while also tending to negatively impact system reliability.

In the exemplary embodiment shown on FIG. 3, each magnetic field sensor 210A-H is deployed so that its axis of sensitivity is substantially radially aligned (i.e., pointing towards the center of the shaft 115), although the invention is not limited in this regard. It will be appreciated by those of ordinary skill in the art that a magnetic sensor is typically sensitive only to the component of the magnetic flux that is aligned (parallel) with the sensor's axis of sensitivity. It will also be appreciated that the exemplary embodiment shown on FIG. 3 results in magnetic flux lines that are substantially radially aligned adjacent magnets 220A and 220B. Therefore, the magnetic sensor 210A-H located closest to magnet 220A tends to sense the highest positive magnetic flux (magnetic flux directed outward for the tool axis) and the sensor closest to magnet 220B tends to sense the highest negative magnetic flux (magnetic flux directed inward towards the tool axis). For example, in the exemplary embodiment shown, magnetic sensor 210A tends to measure the highest positive magnetic flux while sensor 210C tends to measure the highest negative magnetic flux. The invention is not limited by the exemplary sensor orientation depicted on FIG. 3.

Figure 4A:
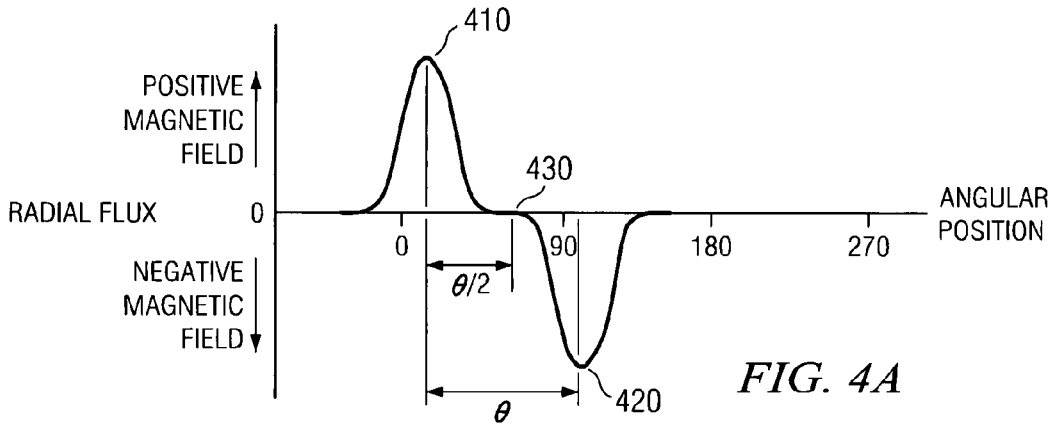
FIG. 4A depicts a plot of magnetic field strength versus angular position emanating from the magnets in the angular sensor deployment shown on FIG. 4.

With reference now to FIG. 4A, a plot of the radial flux emanating from magnets 220A and 220B versus angular position about the shaft 115 is depicted. Note that the radial flux includes positive 510 and negative 520 maxima. As described above, the positive maximum 510 is located radially outward from magnet 220A (i.e., at about 15 degrees in the exemplary embodiment shown). The negative maximum 520 is located radially outward from magnet 220B (i.e., at about 105 degrees in the exemplary embodiment shown). A magnetic flux null 530 (also referred to as a zero-crossing) is located between the positive 510 and negative 520 maxima (i.e., at about 60 degrees in the exemplary embodiment shown). The radial flux depicted in FIG. 4A is for an exemplary embodiment in which the shaft 115 and housing 110 are fabricated from a non-magnetic steel. For embodiments in which the shaft and/or housing are fabricated from a magnetic steel (or other magnetically permeable material), the positive and negative maxima 510 and 520 typically become more sharply defined with respect to angular position. Notwithstanding, it will be appreciated that the relative rotational position of the magnets 220A and 220B (and therefore the shaft) with respect to the magnetic sensors 210A-H (and therefore the housing 110) may be determined by locating the positive and/or negative maxima 510 and 520 or the zero-crossing 530.

Figure 4B:
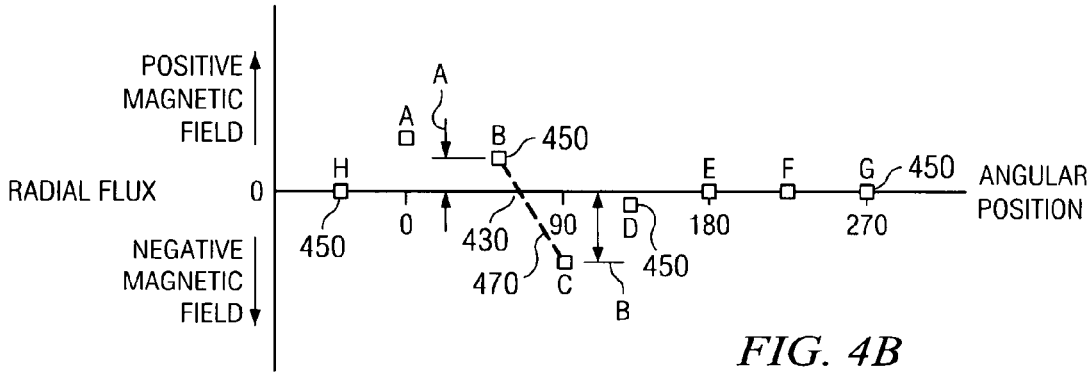
FIG. 4B depicts a plot of exemplary magnetic field strength measurements made by each of the magnetic sensors in the angular sensor deployment shown on FIG. 4.

With reference now to FIG. 4B, a graphical representation of one exemplary mathematical technique for determining the angular position is illustrated. Data points 450 represent the magnetic field strength as measured by each of sensors 210A-H on FIG. 3. In this exemplary sensor embodiment, the angular position half way between magnets 220A and 220B is indicated by zero-crossing 430, the location on the circumferential array of magnetic field sensors at which the magnetic flux is substantially null and at which the polarity of the magnetic field changes from positive to negative (or negative to positive). In the exemplary embodiment shown, zero-crossing 430 is at an angular position of about 60 degrees (as described above with respect to FIG. 3). Note that the position of the zero crossing 430 (and therefore the angular position half way between the magnets 220A and 220B) is located between sensors 210B and 210C. In one exemplary method embodiment, a processor (such as processor 255) first selects adjacent sensors (e.g., sensors 210B and 210C) between which the sign of the magnetic field changes (from positive to negative or negative to positive). The position of the zero crossing 430 may then be determined, for example, by fitting a straight line 470 through the data points on either side of the zero crossing (e.g., between the measurements made by sensors 210B and 210C in the embodiment shown on FIG. 4B).

The location of the zero crossing 820 may then be determined mathematically from the magnetic field measurements, for example, as follows:

$$P = L\left(x + \frac{A}{A+B}\right) \quad \text{Equation 1}$$

where P represents the angular position of the zero crossing, L represents the angular distance interval between adjacent sensors in degrees (e.g., 45 degrees in the exemplary embodiment shown on FIGS. 3 and 5), A and B represent the absolute values of the magnetic field measured on either side of the zero crossing (A and B are shown on FIGS. 4B and 7B), and x is a counting variable having an integer value representing the first of the two adjacent sensors positioned on either side of the zero crossing (such that x=1 for sensor 210A, x=2 for sensor 210B, x=3 for sensor 210C, and so on). In the exemplary embodiments shown on FIGS. 4B and 7B, x=2 (sensor 210B).

It will be appreciated that the magnet arrangement shown on FIG. 3 (including magnets 220A and 220B) tends to result angular position values having small, systematic errors at certain angular positions due to the non-linearly of the magnetic flux profile as a function of angular position. This error is readily corrected, when necessary, using known calibration methods (e.g., look-up tables or polynomial fitting). It will also be appreciated that the magnet arrangement shown on FIG. 3 advantageously makes use of inexpensive and readily available off-the-shelf magnets (e.g., square, rectangular or cylindrical magnets).

Figure 5:
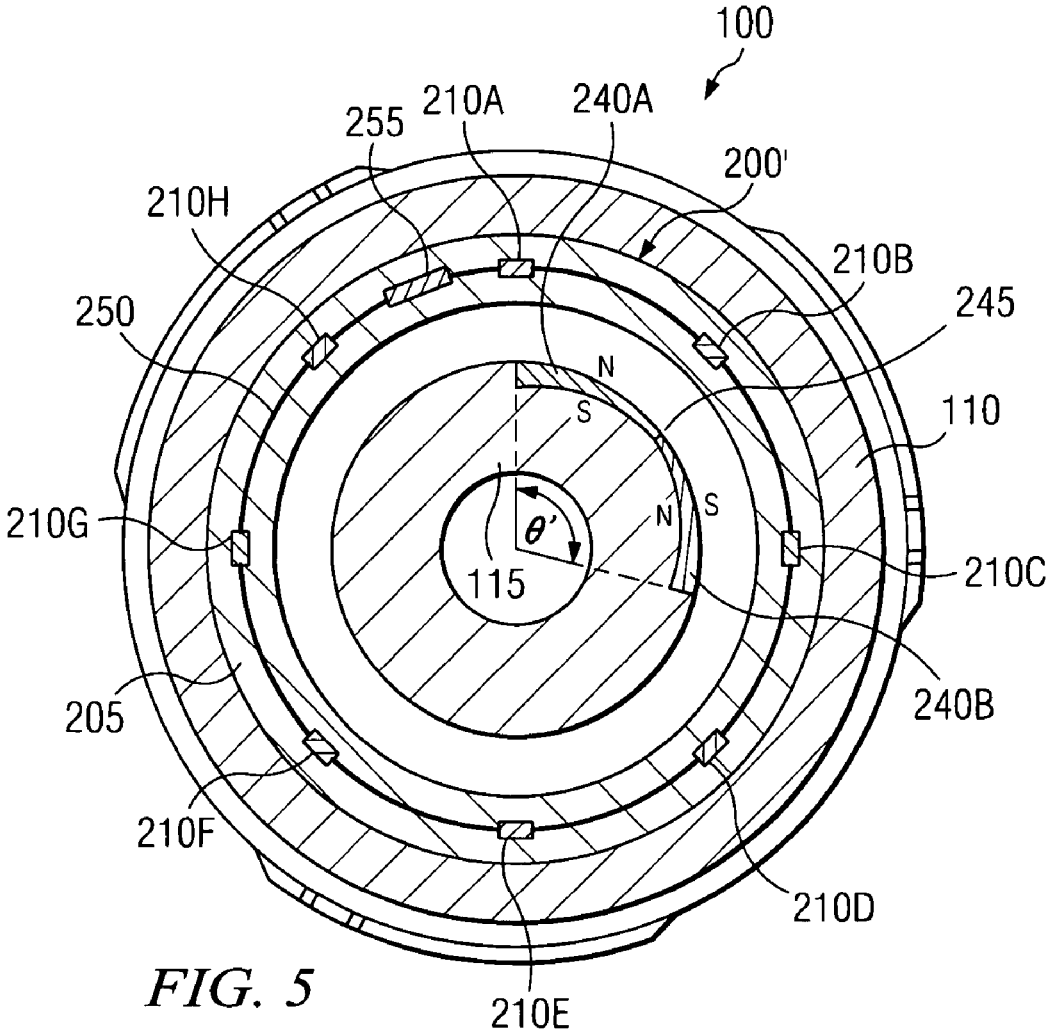
FIG. 5 depicts, in cross section, another exemplary angular sensor deployment in accordance with the present invention.

Turning now to FIG. 5, an alternative embodiment of an angular sensor 200' in accordance with the present invention is depicted in cross section. Angular sensor 200' is also disposed to measure the relative angular position between shaft 115 and housing 110 and may be deployed, for example, in control module 140 (FIG. 2). Sensor 200' is substantially identical to sensor 200 with the exception that it includes first and second tapered, arc-shaped magnets 240A and 240B (also referred to herein as eyebrow magnets) deployed on the shaft 115. One exemplary embodiment of eyebrow magnet 240A is also shown on FIG. 6. Eyebrow magnets 240A and 240B include inner and outer faces 242 and 244, with the outer face 244 having a radius of curvature approximately equal to that of the outer surface of the shaft 115. Eyebrow magnets 240A and 240B also include relatively thick 246 and relatively thin 248 ends. While the invention is not limited in this regard, the thickness of end 246 is at least four times greater than that of end 248 in one exemplary embodiment.

Figure 6:
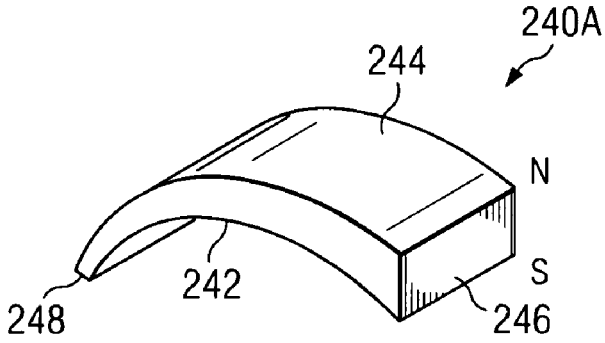
FIG. 6 depicts a perspective view of an exemplary eyebrow magnet utilized in the angular sensor deployment shown on FIG. 6.

In the exemplary embodiment shown, magnets 240A and 240B are substantially identical in shape and have substantially equal and opposite magnetic pole strengths. Magnet 240A includes a magnetic north pole on its outer face 244 and a magnetic south pole on its inner face 242 (FIG. 6). Magnet 240B has the opposite polarity with a magnetic south pole on its outer face 244 and a magnetic north pole on its inner face 242. Magnets 240A and 240B are typically deployed adjacent to one another about the shaft 115 such that their thin ends 248 are in contact (or near contact) with one another. While FIG. 5 shows an exemplary embodiment in which the magnets 240A and 240B are deployed in a tapered recess in the outer surface of the shaft, it will be appreciated that magnets 240A and 240B may be equivalently deployed on the outer surface of the shaft 115. The invention is not limited in these regards. In the exemplary embodiment shown, magnets 240A and 240B each span a circular arc of about 55 degrees about the circumference of the shaft. Thus magnets 240A and 240B in combination span a circular arc θ' of about 110 degrees. The invention is also not limited in these regards (as described in more detail below).

Figure 7A:
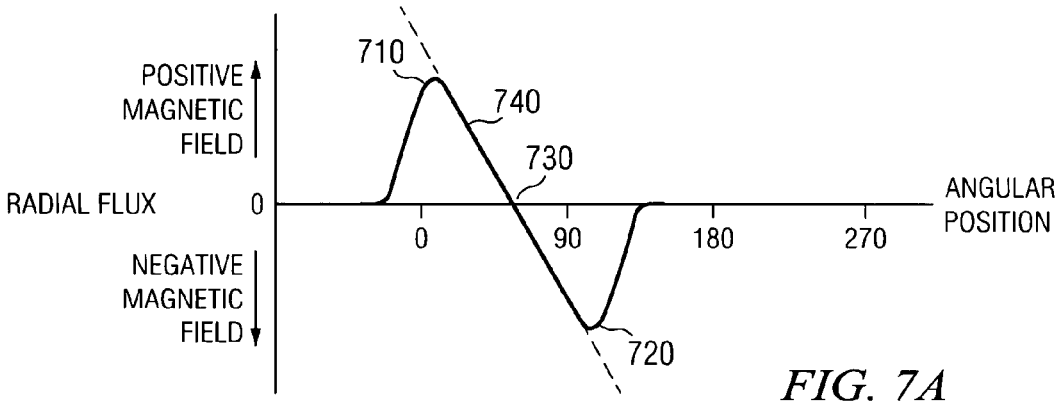
FIG. 7A depicts a plot of magnetic field strength versus angular position emanating from the magnets in the angular sensor deployment shown on FIG. 7.

With reference now to FIG. 7A, a plot of the radial flux emanating from magnets 240A and 240B versus angular position about shaft 115 is depicted. Similar to the embodiment described above with respect to FIGS. 3-4B, the radial flux includes positive 710 and negative 720 maxima. The positive maximum 710 is located radially outward from and near the thick end 246 of magnet 240A (i.e., at an angle of about 5-10 degrees in the exemplary embodiment shown). The negative maximum 720 is located radially outward from and near the thick end of magnet 240B (i.e., at about 100-105 degrees in the exemplary embodiment shown). A magnetic flux null 730 (also referred to as a zero-crossing) is located between the positive 710 and negative 720 maxima (i.e., at about 55 degrees in the exemplary embodiment shown). Moreover, as shown at 740, the radial flux is advantageously substantially linear with angular position between the maxima 710 and 720, which typically eliminates the need for correction algorithms. As described above with respect to angular sensor 200, the relative rotational position of the magnets 240A and 240B (and therefore the shaft) with respect to the magnetic sensors 210A-H (and therefore the housing 110) may be determined from the positive and/or negative maxima 710 and 720 or the zero-crossing 730.

With continued reference to FIG. 7A, and with reference again to FIGS. 5 and 6, eyebrow magnets 240A and 240B may be advantageously sized and shaped to generate a magnetic flux that varies linearly 740 with angular position between the positive and negative maxima 710 and 720. In the exemplary embodiment shown, this linear region 740 spans approximately 95 degrees in angular position. The invention is not limited in this regard, however, as the angular expanse of the linear region 740 may be increased by increasing the arc-length of magnets 240A and 240B and decreased by decreasing the arc-length of magnets 240A and 240B. In general, it is desirable for substantially linear region 740 to have an angular expanse of at least twice the angular interval between adjacent ones of magnetic sensors 210A-H. In this way at least two of the magnetic sensors 210A-H are located in the linear region 740 at all relative angular positions. It will thus be understood that embodiments of the invention utilizing fewer magnetic field sensors desirably utilize eyebrow magnets having a longer arc-length (e.g., about 90 degrees each for an embodiment including five magnetic field sensors). Likewise, embodiments of the invention utilizing more magnetic field sensors may optionally utilize eyebrow magnets having a shorter arc-length (e.g., about 30 degrees each for an embodiment including 16 magnetic field sensors).

Eyebrow magnets 240A and 240B are also advantageously sized and shaped to generate the above described magnetic flux profile (as a function of angular position) for tool embodiments in which both the shaft 115 and the housing 110 are fabricated from a magnetic material such as 4145 low alloy steel. It will be readily understood by those of ordinary skill in the art that the use of magnetic steel is advantageous in that it tends to significantly reduce manufacturing costs (due to the increased availability and reduced cost of the steel itself) and also tends to increase overall tool strength. Notwithstanding, magnets 240A and 240B may also be sized and shaped to generate the above described magnetic profile for tool embodiments in which either one or both of the shaft 115 and the housing 110 are fabricated from nonmagnetic steel.

Figure 7B:
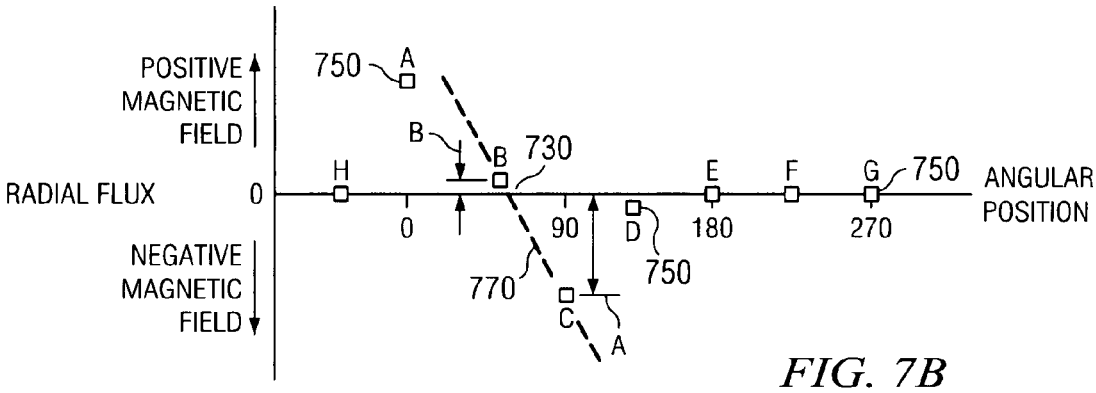
FIG. 7B depicts a plot of exemplary magnetic field strength measurements made by each of the magnetic sensors in the angular sensor deployment shown on FIG. 7.

With reference now to FIG. 7B, a graphical representation of one exemplary mathematical technique for determining the angular position is illustrated. The technique illustrated in FIG. 7B is similar to that described above with respect to FIG. 4B. Data points 750 represent the magnetic field strength values measured by sensors 210A-H on FIG. 5. In this embodiment, the angular position of the contact point 245 between magnets 240A and 240B is indicated by zero-crossing 730, which as described above is the location on the circumferential array of magnetic field sensors 210A-H at which the magnetic flux is substantially null and at which the polarity of the magnetic field changes from positive to negative (or negative to positive). In the exemplary embodiment shown, zero-crossing 730 is at an angular position of about 55 degrees (as described above with respect to FIGS. 5 and 7A). Note that the position of the zero crossing 730 (and therefore the angular position of contact point 245) is located between sensors 210B and 210C. Thus, as described above, a processor may first select adjacent sensors (e.g., sensors 210B and 210C) between which the sign of the magnetic field changes (from positive to negative or negative to positive). The position of the zero crossing 730 may then be determined, for example, by fitting a straight line 770 through the data points on either side of the zero crossing (e.g., between the measurements made by sensors 210B and 210C in the embodiment shown on FIG. 7B). The location of the zero crossing 730 may then be determined mathematically from the magnetic field measurements, for example, via Equation 1 as described above.

The exemplary angular position sensor embodiments shown on FIGS. 3 and 5 include magnetic sensors 210A-H deployed at equal angular intervals about the circumference of housing 110. It will be appreciated that the invention is not limited in this regard. Magnetic sensors 210A-H may alternatively be deployed at unequal intervals. For example, more sensors may be deployed on a one side of the housing 110 than on an opposing side to provide better angular sensitivity on that side of the tool. It will also be appreciated that angular position sensors 200 and 200' are not limited to embodiments in which the magnets are deployed on the shaft 115 and the magnetic sensors 210A-H in the housing. The magnets may be equivalently deployed in the housing 110 and the magnetic sensors 210A-H on the shaft.

It will be appreciated that angular position sensing methods described above with respect to FIGS. 3 through 7B and Equation 1 advantageously require minimal computational resources (minimal processing power), which is critical in downhole applications in which 8-bit microprocessors are commonly used. These methods also provide accurate angular position determination about substantially the entire circumference of the tool. The zero-crossing method tends to be further advantageous in that a wider sensor input range is available (from the negative to positive saturation limits of the sensors).

It will also be appreciated that downhole tools must typically be designed to withstand shock levels in the range of 1000 G on each axis and vibration levels of 50 G root mean square. Moreover, downhole tools are also typically subject to pressures ranging up to about 25,000 psi and temperatures ranging up to about 200 degrees C. With reference again to FIGS. 3 and 5, magnetic field sensors 210A-H are shown deployed in a pressure resistant housing 205. Such an arrangement is preferred for downhole applications utilizing solid state magnetic field sensors such as Hall-Effect sensors and magnetoresistive sensors. In the exemplary embodiment shown, pressure housing 205 includes a sealed ring that is configured to resist downhole pressures which can damage sensitive electronic components. The pressure housing 205 is also configured to accommodate the magnetic field sensors 210A-H and other optional electronics, such as processor 255. Advantageous embodiments of the pressure housing 205 are fabricated from nonmagnetic material, such as P550 (austenitic manganese chromium steel). In the exemplary embodiment shown, magnetic field sensors 210A-H are deployed on a circumferential circuit board array 250, which is fabricated, for example from a flexible, temperature resistant material, such as PEEK (polyetheretherketone). The circumferential array 250, including the magnetic field sensors 210A-H and processor 255, is also typically encapsulated in a potting material to improve resistance to shocks and vibrations.

The magnets utilized in this invention are also typically selected in view of demanding downhole conditions. For example, suitable magnets must posses a sufficiently high Curie Temperature to prevent demagnetization at downhole temperatures. Samarium cobalt ($SaCo_5$) magnets are typically preferred in view of their high Curie Temperatures (e.g., from about 700 to 800 degrees C.). To provide further protection from downhole conditions, the magnets may also be deployed in a shock resistant housing, for example, including a non-magnetic sleeve deployed about the magnets and shaft 115.

In the exemplary embodiments shown on FIGS. 3 and 5, the output of each magnetic sensor may be advantageously electronically coupled to the input of a local microprocessor. The microprocessor serves to process the data received by the magnetic sensors (e.g., according to Equation 1 as described above). In preferred embodiments, the microprocessor (such as processor 255) is embedded with the magnetic field sensors 210A-H in the circumferential array 250, for example, as shown on FIGS. 3 and 5 and therefore located close to the magnetic sensors. In such an embodiment, the microprocessor output (rather than the signals from the individual magnetic sensors) is typically electronically coupled with a main processor which is deployed further away from the magnetic field sensors (e.g., deployed in control module 140 as shown on FIG. 2). This configuration advantageously reduces wiring and feed-through requirements in the body of the downhole tool, which is particularly important in smaller diameter tool embodiments (e.g., tools having a diameter of less than about 12 inches). Digital output from the embedded microprocessor also tends to advantageously reduce electrical interference in wiring to the main processor. Embedded microprocessor output may also be combined with a voltage source line to further reduce the number of wires required, e.g., one wire for combined power and data output and one wire for ground (or alternatively, the use of a chassis ground). This may be accomplished, for example, by imparting a high frequency digital signal to the voltage source line or by modulating the current draw from the voltage source line. Such techniques are known to those of ordinary skill in the art.

In preferred embodiments of this invention, microprocessor 255 (FIGS. 3 and 5) includes processor-readable or computer-readable program code embodying logic, including instructions for calculating a precise angular position of the shaft 115 relative to the housing 110 from the received magnetic sensor measurements. While substantially any logic routines may be utilized, it will be appreciated that logic routines requiring minimal processing power (e.g., as described above with respect to Equation 1) are advantageous for downhole applications (particularly for small-diameter LWD, MWD, and directional drilling embodiments of the invention in which both electrical and electronic processing power are often severely limited).

While the above described exemplary embodiments pertain to rotary steerable tool embodiments including hydraulically actuated blades, it will be understood that the invention is not limited in this regard. The artisan of ordinary skill will readily recognize other downhole uses of angular position sensors in accordance with the present invention. For example, angular position sensors in accordance with this invention may be deployed in conventional and/or steerable drilling fluid (mud) motors and utilized to determine the angular position of drill string components (e.g., MWD or LWD sensors) deployed below the motor with respect to those deployed above the motor. In one exemplary embodiment, the angular position sensor may be disposed, for example, to measure the relative angular position between the rotor and stator in the mud motor.

Near-Bit Gravity Azimuth Measurements

As described above in the Background Section, U.S. Pat. No. 6,480,119 to McElhinney and commonly assigned U.S. Pat. No. 7,080,460 to Illfelder disclose Gravity MWD techniques for determining borehole azimuth via tri-axial accelerometer measurements made at first and second longitudinal positions on a drill string. Using gravity as a primary reference, the disclosed methods make use of the inherent bending of the structure between the accelerometer sets in order to calculate a change in borehole azimuth between the first and second positions.

As also described above, it would be highly advantageous to extend Gravity MWD methods to eliminate the rotational constraint and thereby allow relative rotation between the first and second accelerometer sets. This would advantageously enable conventional tool deployments to be utilized in making Gravity MWD measurements. For example, as described in more detail below, a first (upper) accelerometer set may be deployed in a conventional MWD tool coupled to the drill string and a second accelerometer set may be deployed in the non rotating housing of a rotary steerable tool (e.g., in housing 110 of steering tool 100 shown on FIG. 2). It will be understood that in such a tool configuration the upper set will rotate (with the drill string) with respect to the lower set (which is substantially non-rotating in the borehole during drilling).

Figure 8:
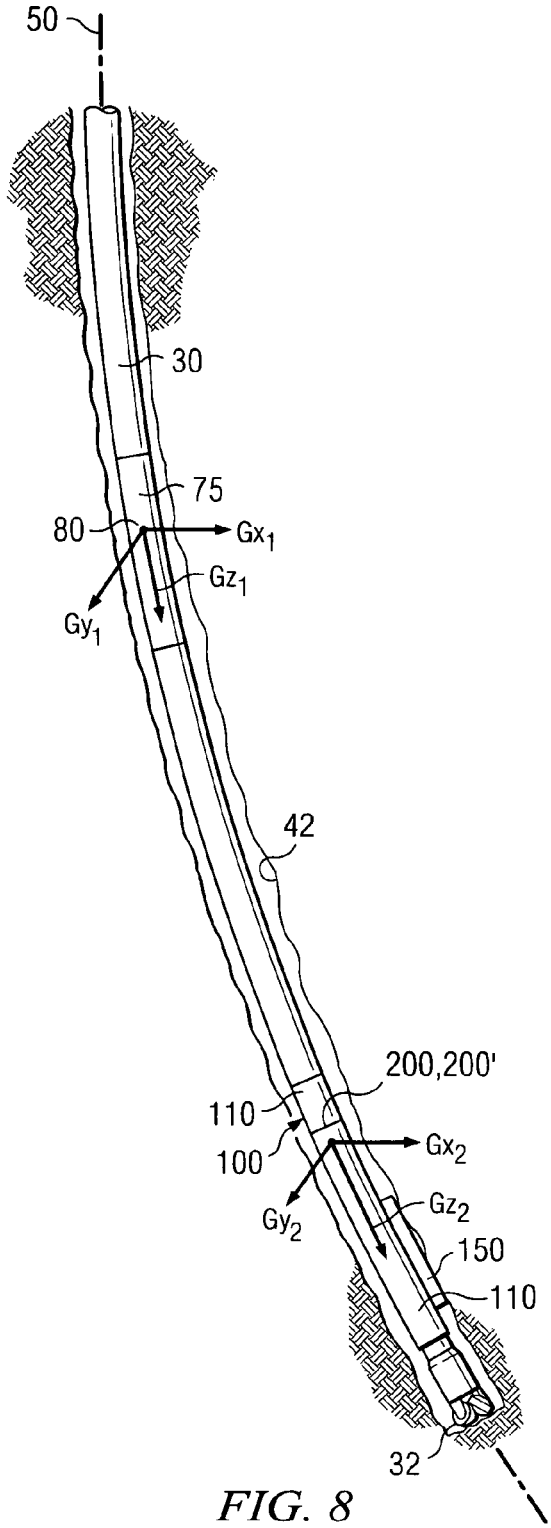
FIG. 8 depicts a bottom hole assembly suitable for use with Gravity MWD embodiments of the present invention.

Referring now to FIG. 8, one exemplary embodiment of a BHA suitable for Gravity MWD method embodiments in accordance with the present invention is illustrated. In FIG. 8, the BHA includes a drill bit assembly 32 coupled with a steering tool 100. Steering tool 100 includes a lower accelerometer set 180 deployed in the substantially non-rotating housing 110. The BHA also includes an MWD tool 75 including an upper accelerometer set 80. The upper and lower accelerometer sets 80 and 180 each typically include three mutually perpendicular (tri-axial) gravity sensors, one of which is oriented substantially parallel with the borehole axis 50 and measures gravity vectors denoted as Gz1 and Gz2 for the upper and lower sensor sets, respectively. The invention is not limited in this regard, however. Each accelerometer set shown on FIG. 8 may thus be considered as determining a plane (Gx and Gy) and a pole (Gz) as shown. The upper 80 and lower 180 accelerometer sets are typically disposed at a known longitudinal spacing in the BHA. The spacing may be, for example, in a range of from about 10 to about 30 meters (i.e., from about 30 to about 100 feet) or more, but the invention is not limited in this regard. Moreover, it will be understood that this invention is not limited to a known or fixed separation between the upper and lower sensor sets 80 and 180.

It will be understood that in the exemplary BHA embodiment shown, MWD tool 75 is rotationally coupled with the drill string 30. As such accelerometer set 80 is free to rotate with respect to accelerometer set 180 about the longitudinal axis 50 of the BHA. During drilling accelerometer set 80 rotates with the drill string 30 in the borehole 42, while accelerometer set 180 is substantially non-rotating with respect to the borehole in housing 110 while blades 150 engage the borehole wall.

With continued reference to FIG. 8, steering tool 100 further includes an angular sensor 200, 200' (FIGS. 3 and 5) disposed to measure an angular position of the housing 110 relative to the drill string 30 (which is rotationally coupled to shaft 115). It will thus be appreciated that angular sensor 200, 200' is also disposed to measure the relative angular position between the upper and lower accelerometer sets 80 and 180 (since set 80 is deployed in MWD tool 75 and set 180 is deployed in housing 110). While the exemplary embodiment shown utilizes angular sensor 200, 200', it will be appreciated that Gravity MWD embodiments of the present invention are not limited to any particular angular sensor embodiments. Any suitable angular sensor may be utilized.

It will also be understood that the invention is not limited to steering tool and/or rotary steerable embodiments, such as that shown on FIG. 8. Rather, Gravity MWD measurements in accordance with this invention may be made using substantially any suitable BHA configuration. In advantageous configurations the upper and lower accelerometer sets 80 and 180 are free to rotate about cylindrical axis 50 with respect to one another. In one alternative configuration enabling such rotational freedom, the upper and lower accelerometer sets 80 and 180 are deployed respectively above and below a conventional and/or steerable mud motor. An angular position sensor may be deployed in the mud motor, e.g., as described above, and utilized to determine the relative angular position between the upper and lower accelerometer sets 80 and 180.

In order to determine the change in borehole azimuth between the upper and lower accelerometer sets 80 and 180 the relative rotation between the sets needs to be accounted. This may be accomplished, for example, by measuring the angular position of housing 110 relative to the drill string 30 concurrently while making accelerometer measurements at sets 80 and 180. The accelerometer measurements at set 180 may then be corrected for the angular offset, for example as follows:

$$Gx2' = (\sqrt{Gx2^2 + Gy2^2})\cos\left(\arctan\left(\frac{Gx2}{Gy2}\right) - A\right) \qquad \text{Equation 2}$$

$$Gy2' = (\sqrt{Gx2^2 + Gy2^2})\sin\left(\arctan\left(\frac{Gx2}{Gy2}\right) - A\right)$$

$$Gz2' = Gz2$$

Where Gx2, Gy2, and Gz2 represent the accelerometer measurements made at the lower accelerometer set 180, Gx2', Gy2', and Gz2' represent the corrected accelerometer measurements, and A represents the measured angular position (the angular offset) between the first and second accelerometer sets 80 and 180. The artisan of ordinary skill in the art will readily recognize that the accelerometer measurements made at the upper set 80 may alternatively be corrected for angular offset (by an angle of −A degrees).

The accelerometer measurements made at the first set 80 and the corrected accelerometer measurements for the second set 180 may then be utilized to calculate the change in borehole azimuth between the first and second sets 80 and 180. This may be accomplished, for example, by substituting Gx2', Gy2', and Gz2' for Gx2, Gy2, and Gz2 in Equations 4 and 5 of U.S. Pat. No. 7,002,484 to McElhinney and solving for the change in borehole azimuth. Alternatively, Gx2', Gy2', and Gz2' may be substituted for Gx2, Gy2, and Gz2 in Column 6 of U.S. Pat. No. 7,028,409 to Engebretson et al. and solving for the change in borehole azimuth.

The relative rotation between the accelerometer sets 80 and 180 may also be accounted by recognizing that such rotation changes the toolface angle of one sensor set with respect to the other. As such, the toolface angle at the lower accelerometer set 180 may be corrected, for example, as follows:

$$TF2'=TF2-A \qquad \text{Equation 3}$$

where TF2 represents the toolface angle of the lower accelerometer set 180 (e.g., of housing 110), TF2' represents the corrected toolface angle, and A represents the measured angular position (the angular offset) between the first and second accelerometer sets 80 and 180. It will of course be understood that the toolface angle at the upper accelerometer may alternatively be corrected (e.g., by the equation: TF1'=TF1+A).

The corrected toolface angle may also be utilized to calculate the change in borehole azimuth between the first and second sets 80 and 180. The Illfelder patent discloses that the change in borehole azimuth may be determined directly from borehole inclination and gravity toolface measurements made at each of the first and second positions according to the following equation (Equation 7 in the Illfelder patent):

$$TF2-TF1=\arctan\left[\frac{\sin(Inc1)\sin(DeltaAzi)}{\sin(Inc2)\cos(Inc1)-\sin(Inc1)\cos(Inc2)\cos(DeltaAzi)}\right]-\arctan\left[\frac{\sin(inc2)\sin(DeltaAzi)}{\sin(Inc2)\cos(Inc1)\cos(DeltaAzi)-\sin(Inc1)\cos(Inc2)}\right] \qquad \text{Equation 4}$$

where Inc1 and Inc2 represent the borehole inclination angles at the first and second positions, TF1 and TF2 represent the gravity toolface angles at the first and second positions, and DeltaAzi represents the change in borehole azimuth between the first and second positions. Those of ordinary skill in the art will readily be able to calculate the borehole inclination and gravity toolface angles directly from the accelerometer measurements (e.g., using Equations 1 through 4 disclosed in the Illfelder patent). The change in borehole azimuth may then be determined, for example, by substituting TF2' for TF2 in Equation 4 and solving for the change in borehole azimuth (DeltaAzi) as described in the Illfelder patent.

The Illfelder patent further discloses that the change in borehole azimuth, DeltaAzi, can be determined from Equation 4 using numerical root finding algorithms, graphical methods, and/or look-up tables. Such methods are readily available and easily utilized at the surface, e.g., via a conventional PC using software routines available in MathCad® and/or Mathematica®. However, it is difficult to apply such numerical and/or graphical methods using on-board, downhole processors due to their limited processing power. Therefore there also exists a need for a simplified method for determining DeltaAzi, preferably including an equation that can be readily solved using a low-power, downhole processor.

Using linear regression techniques and trigonometric function fitting techniques Equation 4 may be rewritten in simplified form as follows:

$$DeltaAzi=\frac{TF2-TF1}{0.008759(Inc2-Inc1)\sin(Inc1)-\cos(Inc1)} \qquad \text{Equation 5}$$

where Inc1, Inc2, TF1, TF2, and DeltaAzi are defined above with respect to Equation 4. In Equation 5, the numerical coefficient 0.008759 is selected for use with input parameters Inc1, Inc2, TF1, and TF2 being in units of degrees. Equivalent equations can be readily derived by those of ordinary skill in the art for other angular units, e.g. radians. Equation 5 has been found to provide a highly accurate approximation of Equation 4, with a resulting DeltaAzi error of less than 0.03 degrees over nearly the entire range of possible borehole inclination, borehole azimuth, and gravity toolface values. Those of ordinary skill in the art will readily recognize that an error of less than 0.03 degrees is negligible in comparison, for example, to errors in the inclination and gravity toolface angles used to compute DeltaAzi. Those of ordinary skill in the art will also readily recognize that Equation 5 may be rewritten to express DeltaAzi as a function of Gx1, Gy1, Gz1, Gx2, Gy2, and Gz2.

It will be appreciated that the present invention advantageously provides for downhole determination of a near-bit borehole azimuth that is substantially free from magnetic interference. For example, in the exemplary embodiment shown on FIG. 8, the lower sensor set 180 is deployed in steering tool 100 just above the drill bit. Such a near-bit borehole azimuth may be determined, for example, via the following equation:

$$Azi2=Azi1+DeltaAzi=Azi1+\frac{TF2-A-TF1}{0.008759(Inc2-Inc1)\sin(Inc1)-\cos(Inc1)} \qquad \text{Equation 6}$$

where Azi2 represents the near-bit borehole azimuth in degrees (i.e., the borehole azimuth at the lower accelerometer set), Azi1 represents the borehole azimuth in degrees at the upper accelerometer set (e.g., determined via concurrent magnetometer measurements made at the upper set), and Inc1, Inc2, TF1, TF2, and DeltaAzi are defined above in degrees with respect to Equation 4.

Due to their simplicity, Equations 5 and 6 are especially well suited for use with downhole microcontrollers having limited processing power. Equation 6, for example, advantageously includes only 5 subtractions/additions, 2 multiplies, 1 division, and 2 trigonometry functions. It will be appreciated that Azi2 (or DeltaAzi) may be advantageously computed at substantially any downhole microcontroller deployed substantially anywhere in the BHA. For example, Azi2 may be computed at a microcontroller located in MWD tool 75. To facilitate such computations, Inc2 and TF2 may be transmitted (e.g., via relatively high-speed communication bus among downhole tools) from accelerometer set 180 to MWD tool 75. Alternatively and/or additionally Azi2 may be computed at a microcontroller located in housing 110. To facilitate such computations, Inc1, TF1, and Azi1 may be transmitted from accelerometer set 80 to the microcontroller in housing 110. However, the invention is not limited in this regard. In some high-technology rigs, raw data may be telemetered to the surface via wired drill pipe connections providing high speed communication (e.g., 56 Kbps or 1 M bps). Those of ordinary skill in the art will readily recognize that the measurement of near-bit borehole azimuth may be advantageously utilized for several purposes. For example, the combination of near-bit borehole azimuth and near-bit borehole inclination provides a substantially real time indication of the bearing direction of a borehole during drilling, which enables errors in bearing to be quickly recognized and corrected.

Near-bit azimuth measurements may also be advantageously utilized in closed-loop methods for controlling the direction of drilling. For example, the drilling direction may be controlled such that predetermined borehole inclination and borehole azimuth values are maintained. Alternatively, a predetermined borehole curvature (e.g., build rate, turn rate, or other dogleg) may be maintained. The build and turn rates of the borehole may be expressed mathematically, for example, as follows:

$$BuildRate = \frac{Inc2 - Inc1}{d} \quad \text{Equation 7}$$

$$TurnRate = \frac{Azi2 - Azi1}{d} \quad \text{Equation 8}$$

where Inc1, Inc2, Azi1 and Azi2 are defined above with respect to Equations 4 and 6 and d is the axial distance between the first and second accelerometer sets 80 and 180. As is known to those of ordinary skill in the art, the combination of build rate and turn rate fully define the curvature of the borehole (both the direction and severity of the curve). Thus, an exemplary closed-loop control method may advantageously control the curvature of the borehole during drilling by controlling the build rate and turn rate (as determined in Equations 7 and 8) to be within predetermined limits. One such closed-loop method is disclosed in commonly assigned U.S. Patent Publication No. 2005/0269082.

Although the present invention and its advantages have been described in detail, it should be understood that various changes, substitutions and alternations may be made herein without departing from the spirit and scope of the invention as defined by the appended claims.

I claim:

1. A method for surveying a subterranean borehole, the method comprising:

(a) providing a string of downhole tools including first and second gravity measurement devices at corresponding first and second longitudinal positions in the borehole, the first and second gravity measurement devices being substantially free to rotate with respect to one another about a substantially cylindrical borehole axis, the string of tools further including an angular position sensor disposed to measure a relative angular position between the first and second gravity measurement devices;

(b) causing the first and second gravity measurement devices to measure corresponding first and second gravity vector sets;

(c) causing the angular position sensor to measure a corresponding relative angular position between the first and second gravity measurement devices; and (d) processing the first and second gravity vector sets and the angular position to calculate a change in borehole azimuth between the first and second positions in the borehole.

2. The method of claim 1, wherein the first and second gravity measurement devices each comprise tri-axial accelerometer sets.

3. The method of claim 1, wherein the first gravity measurement device is deployed in a measurement while drilling sub rotationally coupled with a drill string and the second gravity measurement device is deployed in a substantially non-rotating steering tool housing.

4. The method of claim 3, wherein (d) further comprises:

(i) processing at the measurement while drilling sub the first gravity vector set to calculate a borehole inclination and a toolface angle at the first position;

(ii) transmitting the borehole inclination and the toolface angle at the first position from the measurement while drilling sub to the steering tool;

(iii) processing at the steering tool the second gravity vector set to calculate a borehole inclination and a toolface angle at the second position; and (iv) processing at the steering tool the relative angular position between the first and second gravity measurement devices, the borehole inclination and the toolface angle at the first position, and the borehole inclination and the toolface angle at the second position to calculate the change in borehole azimuth between the first and second gravity measurement devices.

5. The method of claim 3, wherein (d) further comprises:

(i) processing at the steering tool the second gravity vector set to calculate a borehole inclination and a toolface angle at the second position;

(ii) transmitting the borehole inclination and the toolface angle at the second position from the steering tool to the measurement while drilling sub;

(iii) processing at the measurement while drilling sub the first gravity vector set to calculate a borehole inclination and a toolface angle at the first position; and (iv) processing at the measurement while drilling sub the relative angular position between the first and second gravity measurement devices, the borehole inclination and the toolface angle at the first position, and the borehole inclination and the toolface angle at the second position to calculate the change in borehole azimuth between the first and second gravity measurement devices.

6. The method of claim 1, wherein the first gravity measurement device is deployed above a mud motor and the second gravity measurement device is deployed below the mud motor.

7. The method of claim 1, wherein the angular position sensor comprises:

a plurality of magnets circumferentially spaced about a first downhole tool component, the magnets being rotationally coupled to the first gravity measurement sensor; and a plurality of magnetic field sensors circumferentially spaced about a second downhole tool component, the magnetic field sensors being rotationally coupled to the second gravity measurement sensor, at least one of the magnetic field sensors being in sensory range of magnetic flux from at least one of the magnets.

8. The method of claim 7, wherein (e) further comprises:

(i) causing each of the magnetic field sensors to measure a magnetic flux; and (ii) processing the magnetic flux measurements to determine the relative angular position between the first and second gravity measurement sensors.

9. The method of claim 1, wherein (d) further comprises:

(i) processing the relative angular position and the second gravity vector set to calculate a corrected gravity vector set; and (ii) processing the first gravity vector set and the corrected gravity vector set to calculate a change in borehole azimuth between the first and second positions in the borehole.

10. The method of claim 9, wherein the corrected gravity vector set is calculated in (i) according to the equation:

$$Gx2' = (\sqrt{Gx2^2 + Gy2^2})\cos\left(\arctan\left(\frac{Gx2}{Gy2}\right) - A\right)$$

$$Gy2' = (\sqrt{Gx2^2 + Gy2^2})\sin\left(\arctan\left(\frac{Gx2}{Gy2}\right) - A\right)$$

$$Gz2' = Gz2$$

wherein Gx2', Gy2', and Gz2' represent the corrected gravity vector set, Gx2, Gy2, and Gz2 represent the second gravity vector set, and A represents the relative angular position between the first and second gravity measurement devices.

11. The method of claim 1, wherein (d) further comprises:

(i) processing the first and second gravity vector sets to calculate borehole inclination and toolface angles at the first and second positions in the borehole;

(ii) processing the relative angular position, the borehole inclination at the first and second positions, and the toolface angles at the first and second positions to calculate a change in borehole azimuth between the first and second positions in the borehole.

12. The method of claim 11, wherein the change in azimuth is calculated in (ii) according to the equation:

$$DeltaAzi = \frac{TF2 - A - TF1}{0.008759(Inc2 - Inc1)\sin(Inc1) - \cos(Inc1)}$$

wherein DeltaAzi represents the change in azimuth between the first and second positions, TF1 and TF2 represent the toolface angles at the first and second positions, Inc1 and Inc2 represent the borehole inclination at the first and second positions, and A represents the relative angular position between the first and second gravity measurement devices.

13. The method of claim 1, wherein (d) further comprises:

(i) processing the first and second gravity vector sets to calculate borehole inclination and toolface angles at the first and second positions in the borehole;

(ii) processing the angular position and the toolface angle at the second position in the borehole to calculate a corrected toolface angle; and (iii) processing the borehole inclination at the first and second positions, the toolface angle at the first position, and the corrected toolface angle to calculate a change in borehole azimuth between the first and second positions in the borehole.

14. A method for surveying a subterranean borehole, the method comprising:

(a) providing first and second gravity measurement devices at corresponding first and second longitudinal positions in the borehole;

(b) causing the first and second gravity measurement devices to measure corresponding first and second gravity vector sets;

(c) processing downhole the first and second gravity vector sets to calculate borehole inclination and toolface angles at the first and second positions in the borehole; and (d) processing downhole the borehole inclination and toolface angles at the first and second positions to calculate a change in borehole azimuth between the first and second positions in the borehole, wherein the change of azimuth is calculated according to the equation:

$$DeltaAzi = \frac{TF2 - TF1}{0.008759(Inc2 - Inc1)\sin(Inc1) - \cos(Inc1)}$$

wherein DeltaAzi represents the change in azimuth between the first and second positions. TF1 and TF2 represent the toolface angles at the first and second positions, and Inc1 and Inc2 represent the borehole inclination at the first and second positions.

15. A closed-loop method for controlling the direction of drilling of a subterranean borehole, the method comprising:

(a) providing a string of downhole tools including first and second gravity measurement devices at corresponding first and second longitudinal positions in the borehole, the first and second gravity measurement devices being substantially free to rotate with respect to one another about a substantially cylindrical borehole axis, the string of tools further including an angular position sensor disposed to measure a relative angular position between the first and second gravity measurement devices;

(b) causing the first and second gravity measurement devices to measure corresponding first and second gravity vector sets;

(c) causing the angular position sensor to measure a corresponding relative angular position between the first and second gravity measurement devices; and (d) processing the first and second gravity vector sets and the angular position to control the direction of drilling of the subterranean borehole.

16. The method of claim 15, wherein (d) further comprises:

(i) processing the first and second gravity vector sets and the angular position to determine a borehole inclination and a borehole azimuth at the second position;

(ii) processing the borehole inclination and a borehole azimuth at the second position in combination with a preordained borehole inclination and borehole azimuth to control the direction of drilling of the subterranean borehole.

17. The method of claim 15, wherein (d) further comprises:

(i) processing the first and second gravity vector sets and the angular position to determine a change in borehole inclination and a change in borehole azimuth between the first and second positions;

(ii) processing the change in borehole inclination and the change in borehole azimuth in combination with preordained changes in the borehole inclination and the borehole azimuth to control the direction of drilling of the subterranean borehole.

18. The method of claim 15, wherein the first gravity measurement device is deployed in a measurement while drilling sub rotationally coupled with a drill string and the second gravity measurement device is deployed in a substantially non-rotating steering tool housing, the steering tool housing including at least one blade disposed to extend radially outward from the housing into contact with the borehole wall.

19. The method of claim 18, wherein (d) further comprises processing the first and second gravity vector sets and the angular position to control extension and retraction of the at least one blade.

20. The method of claim 15, wherein the angular position sensor comprises:

a plurality of magnets circumferentially spaced about a first downhole tool component, the magnets being rotationally coupled to the first gravity measurement sensor; and a plurality of magnetic field sensors circumferentially spaced about a second downhole tool component, the magnetic field sensors being rotationally coupled to the second gravity measurement sensor, at least one of the magnetic field sensors being in sensory range of magnetic flux from at least one of the magnets.

21. A system for providing near-bit surveying measurement of a subterranean borehole while drilling, the system comprising:

a measurement while drilling sub including a first gravity measurement sensor set, the measurement while drilling sub disposed to be coupled with a drill string;

a steering tool including a housing deployed about a shaft, the shaft disposed to be coupled with the drill string, the housing and the shaft substantially free to rotate with respect to one another, the steering tool further including an angular position sensor disposed to measure the relative angular position between the housing and the shaft, the housing including a second gravity measurement sensor set;

a downhole controller disposed to:

(a) cause the first and second gravity measurement sensor sets to measure corresponding first and second gravity vector sets;

(b) cause the angular position sensor to measure a corresponding relative angular position between the housing and the shaft; and (c) process the first and second gravity vector sets and the angular position to calculate a change in borehole azimuth between the first and second sensor sets.

22. The system of claim 21, wherein the angular position sensor comprises:

a plurality of magnets circumferentially spaced about the shaft, the magnets being rotationally coupled to the first gravity measurement sensor; and a plurality of magnetic field sensors circumferentially spaced about the housing, the magnetic field sensors being rotationally coupled to the second gravity measurement sensor, at least one of the magnetic field sensors being in sensory range of magnetic flux from at least one of the magnets.

23. The method of claim 21, wherein the change in borehole azimuth is calculated in (c) according to the equation:

$$DeltaAzi = \frac{TF2 - A - TF1}{0.008759(Inc2 - Inc1)\sin(Inc1) - \cos(Inc1)}$$

wherein DeltaAzi represents the change in azimuth between the first and second positions, TF1 and TF2 represent toolface angles at the first and second sensor sets, Inc1 and Inc2 represent borehole inclination at the first and second sensor sets, and A represents the relative angular position between the first and second gravity measurement devices.

24. The method of claim 21, wherein the controller is further disposed to:

(d) process the change in borehole azimuth calculated in (c) to control extension and retraction of the at least one blade deployed in the steering tool housing.

* * * * *